US008720536B2

(12) United States Patent
Vaughn et al.

(10) Patent No.: US 8,720,536 B2
(45) Date of Patent: May 13, 2014

(54) HEAT EXCHANGER HAVING FLOW DIVERTER

(75) Inventors: James J. Vaughn, Cudahy, WI (US); Victor G. Nino, Oak Creek, WI (US)

(73) Assignee: Modine Manufacturing Company, Racine, WI (US)

( * ) Notice: Subject to any disclaimer, the term of this patent is extended or adjusted under 35 U.S.C. 154(b) by 924 days.

(21) Appl. No.: 12/873,390

(22) Filed: Sep. 1, 2010

(65) Prior Publication Data

US 2011/0056654 A1 Mar. 10, 2011

Related U.S. Application Data

(60) Provisional application No. 61/239,916, filed on Sep. 4, 2009.

(51) Int. Cl.
*F28F 9/02* (2006.01)

(52) U.S. Cl.
USPC ..... 165/174

(58) Field of Classification Search
USPC ..... 165/109.1, 174, 178; 62/525
See application file for complete search history.

(56) References Cited

U.S. PATENT DOCUMENTS

| | | | | | |
|---|---|---|---|---|---|
| 1,853,189 | A * | 4/1932 | Bancel | 165/174 |
| 2,099,186 | A * | 11/1937 | Anderegg | 165/174 |
| 4,390,997 | A * | 7/1983 | Hinz et al. | 165/174 |
| 4,524,823 | A * | 6/1985 | Hummel et al. | 165/174 |
| 5,107,924 | A * | 4/1992 | Herbert et al. | 165/174 |
| 5,186,249 | A | 2/1993 | Bhatti et al. | |
| 5,284,203 | A * | 2/1994 | Dauvergne | 165/174 |
| 5,625,112 | A | 4/1997 | Ragi et al. | |
| 6,199,401 | B1 * | 3/2001 | Haussmann | 62/525 |
| 7,152,669 | B2 * | 12/2006 | Kroetsch et al. | 165/174 |
| 7,490,661 | B2 * | 2/2009 | Nishino et al. | 165/174 |
| 7,549,466 | B2 * | 6/2009 | Hayashi et al. | 165/174 |
| 2007/0039724 | A1 * | 2/2007 | Trumbower et al. | 165/174 |
| 2008/0023184 | A1 * | 1/2008 | Beamer et al. | 165/174 |
| 2008/0029254 | A1 * | 2/2008 | Sekito et al. | 165/148 |

FOREIGN PATENT DOCUMENTS

JP 2008256234 10/2008

OTHER PUBLICATIONS

First Office Action from The State Intellectual Property Office of the People's Republic of China for Application No. 201010276405.X dated Dec. 17, 2013 (8 pages).

* cited by examiner

*Primary Examiner* — Leonard R Leo
(74) *Attorney, Agent, or Firm* — Michael Best & Friedrich LLP

(57) ABSTRACT

A heat exchanger including a tank with first and second ends defining a length and a cross-sectional area transverse to the length. An inlet orifice defined at the first end through which fluid flows in a first direction into the tank, the inlet orifice having a cross-sectional area transverse to the first direction. A voluminous region defined by boundaries which extend generally linearly from the circumference of the cross-sectional area of the inlet orifice to the circumference of the cross-sectional area of the tank. A plurality of conduits providing an outlet for fluid flow from the tank in a second flow direction at a non-parallel angle to the first flow direction. A flow diverter positioned within the voluminous region to direct a portion of fluid flow out of the region and distribute the total volume of fluid flow from the inlet substantially uniformly between the plurality of conduits.

24 Claims, 8 Drawing Sheets

HEAT EXCHANGER HAVING FLOW DIVERTER

CROSS REFERENCE TO RELATED APPLICATIONS

This application claims priority to U.S. Provisional Patent Application No. 61/239,916, filed on Sep. 4, 2009, the entirety of which is incorporated herein by reference.

FIELD OF THE INVENTION

This invention relates to heat exchangers, and more particularly to heat exchangers incorporating internal flow directing features for uniform distribution of a heat transfer fluid.

BACKGROUND

One method of construction for heat exchangers that is frequently employed (for example, in radiators for internal combustion engines) relies upon a heat exchange core comprised of multiple parallel flattened tubes interleaved with and bonded to corrugated fin structures. Such heat exchangers function by transferring heat between a first fluid (engine coolant, for example) traveling through the tubes and a second fluid (air, for example) passing over the tubes through the corrugated fin structures.

In order to prevent leakage of the first fluid as it passes through such a heat exchanger, the tubes are typically fastened to a header plate at either end, and the header plates are in turn each fastened to a tank. The first fluid enters one of the tanks (the inlet tank) through an inlet port, and exits one of the tanks (the outlet tank) through an outlet port. The inlet tank thus serves as a fluid manifold to distribute the fluid from the inlet port to the tubes.

In order to optimize the heat transfer performance of the heat exchanger, it is highly desirable for the first fluid to distribute evenly between the multiple tubes. In many cases the design of the inlet tank and its inlet port is specifically directed towards producing as uniform a flow distribution between the tubes as possible. However, in many applications this can be made difficult by restrictions imposed upon the heat exchanger by other parts of the system. In some applications, the inlet port may need to be located in an area of the inlet tank that makes uniform distribution of the fluid difficult to achieve. In some applications the available space for fluid lines may be so limited as to require a line size that results in the fluid entering the inlet tank at a high velocity, also making uniform distribution of the fluid difficult to achieve.

When the inlet port is oriented in a direction that is parallel to the axial direction of the tubes, the flow distribution in the tubes may be improved by the addition of a baffle plate located within the inlet tank so that the flow entering the tank through the inlet port impinges thereon. The impingement of the flow upon the baffle plate prevents the fluid from flowing disproportionately through the tubes immediately adjacent the inlet port. Such a solution to the problem of flow distribution in heat exchangers of this type is described in greater detail in U.S. Pat. No. 5,186,249.

The inventors have found that a baffle such as described above does not adequately prevent flow maldistribution through the heat exchanger tubes when the inlet port is instead oriented in a direction perpendicular to the axial direction of the tubes. This has been found to be especially true in cases where the flow area of the inlet port is sufficiently small relative to the fluid flow rate so that the fluid enters the inlet tank in a turbulent flow regime. Thus, there is still room for improvement.

SUMMARY OF THE INVENTION

In some embodiments, the invention can provide a heat exchanger including a tank having a first end and a second end defining a tank length therebetween as well as a connector positioned at the first end of the tank and providing an inlet for fluid flow into the tank in a first general flow direction. The heat exchanger can also include a plurality of tube slots defined along the length of the tank between a first position adjacent the first end and a second position adjacent the second end, each tube slot receiving a tube, each tube providing an outlet for fluid flow from the tank in a second general flow direction, the second flow direction at a non-parallel angle with respect to the first general flow direction. A flow diverter can be positioned in the tank at a third position between the first position and the second position to direct at least a portion of fluid flow away from the first general flow direction and thereby distribute the fluid flow from the inlet substantially evenly to each of the plurality of tubes, the flow diverter including at least one elongated projection oriented such that the elongated dimension is generally transverse to the first general flow direction.

Some embodiments of the invention can provide a heat exchanger including a tank having a first end and a second end defining a length therebetween and a cross-sectional area of the tank transverse to the length. An inlet orifice can be defined at the first end of the tank through which fluid flows in a first direction into the tank, the inlet orifice having a cross-sectional area transverse to the first direction. The heat exchanger can also include a voluminous region extending a distance from the first end and defined by boundaries which extend generally linearly from the circumference of the cross-sectional area of the inlet orifice to the circumference of the cross-sectional area of the tank at the distance. The heat exchanger can further include a plurality of apertures arranged along the length of the tank, each aperture receiving one of a plurality of conduits, each conduit providing an outlet for fluid flow from the tank in a second direction, the second flow direction at a non-parallel angle with respect to the first flow direction. A flow diverter can be positioned within the voluminous region of the tank to direct a portion of fluid flow out of the voluminous region and thereby distribute the total volume of fluid flow from the inlet substantially uniformly between the plurality of conduits.

In some embodiments, the invention can provide a heat exchanger including a tank having first and second ends defining a first tank dimension therebetween, and at least one wall defining a cross-sectional area of the tank. The heat exchanger can also include an inlet port positioned at the first end of the tank, a plurality of tube slots defined in a wall of the tank along the first tank dimension, and a plurality of projections positioned on the at least one wall. At least one of the plurality of projections can be located a first distance from the first end along the first tank dimension, the projections can be positioned to divert a portion of fluid from the inlet port to at least one tube slot positioned a second distance from the first end along the first tank dimension, the second distance being less than the first distance.

Other features, aspects, objects and advantages of the invention will become apparent from a complete reading of the specification and accompanying drawings.

DETAILED DESCRIPTION OF THE PREFERRED EMBODIMENT

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
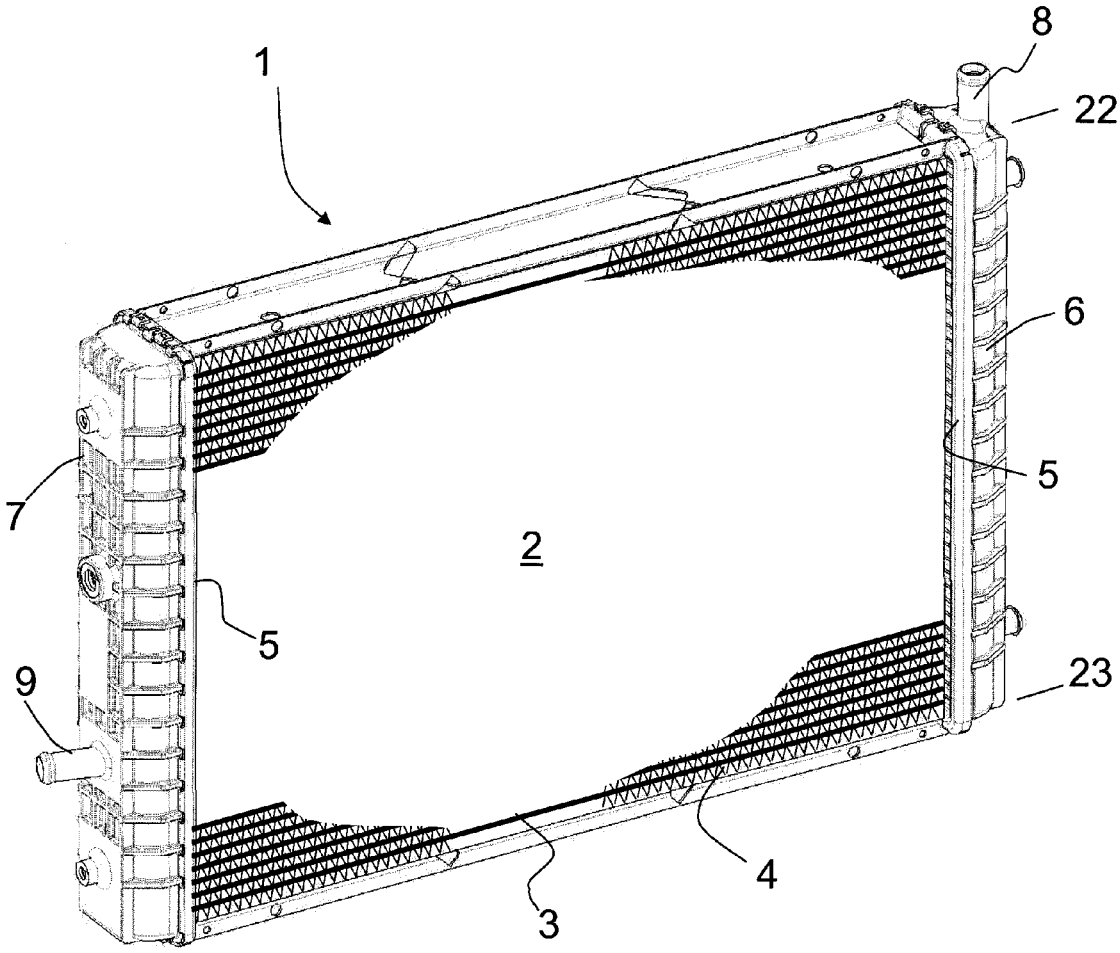
FIG. 1 is an isometric view of a heat exchanger especially suited for deriving benefit from an embodiment of the present invention.

FIG. 1 depicts an exemplary heat exchanger 1 that can be used, for example, as a radiator for cooling a liquid coolant for an internal combustion engine. The depicted heat exchanger includes a heat exchange core 2 comprising a multitude of parallel flattened heat exchange tubes 3 interleaved with convoluted fins 4. In a typical application of this type of heat exchanger, a liquid coolant is conveyed through the heat exchanger tubes 3 while air is directed through the fins 4, so that heat from the coolant may be rejected to the air. In other embodiments, the heat exchanger core 2 can be comprised of stacked plates which form flow passages for working fluids therebetween. In further embodiments, stacked plates forming fluid passages therebetween can alternatively be interleaved with convoluted fins to form a heat exchanger core 2. While the illustrated embodiments include a heat exchanger core 2 comprising tubes 3 and fins 4, it should be understood that the invention can be used in conjunction with various types of heat exchanger cores.

The tubes 3 can be sealingly attached to a pair of header plates 5 at opposite ends of the tubes 3 by way of a number of apertures or tube slots 10 in each of the header plates 5 (best seen in FIG. 2), so that the tubes 3 may provide a leak-free path/passage for a fluid (for example, a coolant) from an inlet tank 6 to an outlet tank 7. Both the inlet tank 6 and the outlet tank 7 can be sealingly attached to one of the header plates 5. Alternatively, the inlet and outlet tanks 6, 7 and the header plates 5 can be integrally formed such that the tube slots 10 are defined in a wall of the tank. In some exemplary embodiments, the tubes 3 and header plates 5 may be constructed from a brazeable, weldable, or solderable material such as aluminum, so that the attachment of the tubes 3 to the header plates 5 may be accomplished by brazing, welding, or soldering. In some embodiments, one or both tanks 6, 7 can be formed of a polymer as is known in the art. The header plates 5 can also be formed of a suitable polymer. The tubes 3 can be sealingly secured within the tube slots 10 with a bonding adhesive such as epoxy.

The inlet tank 6 of the heat exchanger 1 includes a proximal end 22 and a distal end 23, with the tube slots 10 arranged there-between along a length of the tank. The circumferential shape and cross-sectional area (which determine the hydraulic diameter $d_2$) of the inlet tank 6 can vary from one embodiment to another. The inlet tank 6 further includes an inlet connector 8 at the proximal end 22 to provide a fluid inlet port through which a coolant flow may enter the inner volume of the inlet tank 6. It should be understood that the proximal and distal ends of the inlet tank 6 are so identified in order to facilitate description of the illustrated embodiment, and that the end of the inlet tank 6 having the inlet connector 8 can alternatively be referred to as the distal end. The circumferential shape and cross-sectional area (which determine the hydraulic diameter $d_1$) of the connector 8 and the orifice defining the inlet port can vary from one embodiment to another, as can the angle at which the connector 8 is positioned with respect to the proximal end 22 of the tank 6. The angle at which the connector 8 is oriented with respect to the end 22 of the inlet tank 6 determines a first flow direction of fluid into the tank 6.

During operation of the heat exchanger 1, the orientation of the tubes 3 with respect to the inlet tank 6 define a second flow direction for the fluid traveling out of the tank 6. In general, the invention is directed to heat exchangers 1 in which the first and second flow directions are at non-parallel angles with respect to each other. According to some embodiments of the invention, the first and second flow directions can be between 45 and 135 degrees with respect to each other. As in the illustrated embodiments, the tubes 3 can be positioned such that the second flow direction is approximately perpendicular to the first flow direction defined by the connector 8.

The outlet tank 7 of the heat exchanger 1 includes an outlet connector 9 through which the fluid received into the outlet tank 7 from the tubes 3 may be removed from the heat exchanger 1. In certain embodiments, the orientation of the connector 9 may be parallel to the flow direction defined by the tubes 3, as shown in the embodiment of FIG. 1. In other embodiments, it may be preferable to orient the outlet connector 9 to be parallel to the inlet connector 8. In other embodiments, the connector 9 may have other orientations with respect to one or more of the tubes 3, such as, for example, at a non-parallel, non-perpendicular angle with respect to a flow direction defined by the fluid through an adjacent tube 3, or alternatively, the connector 9 can have an arcuate or other non-linear orientation with respect to an adjacent tube 3.

Figure 3:
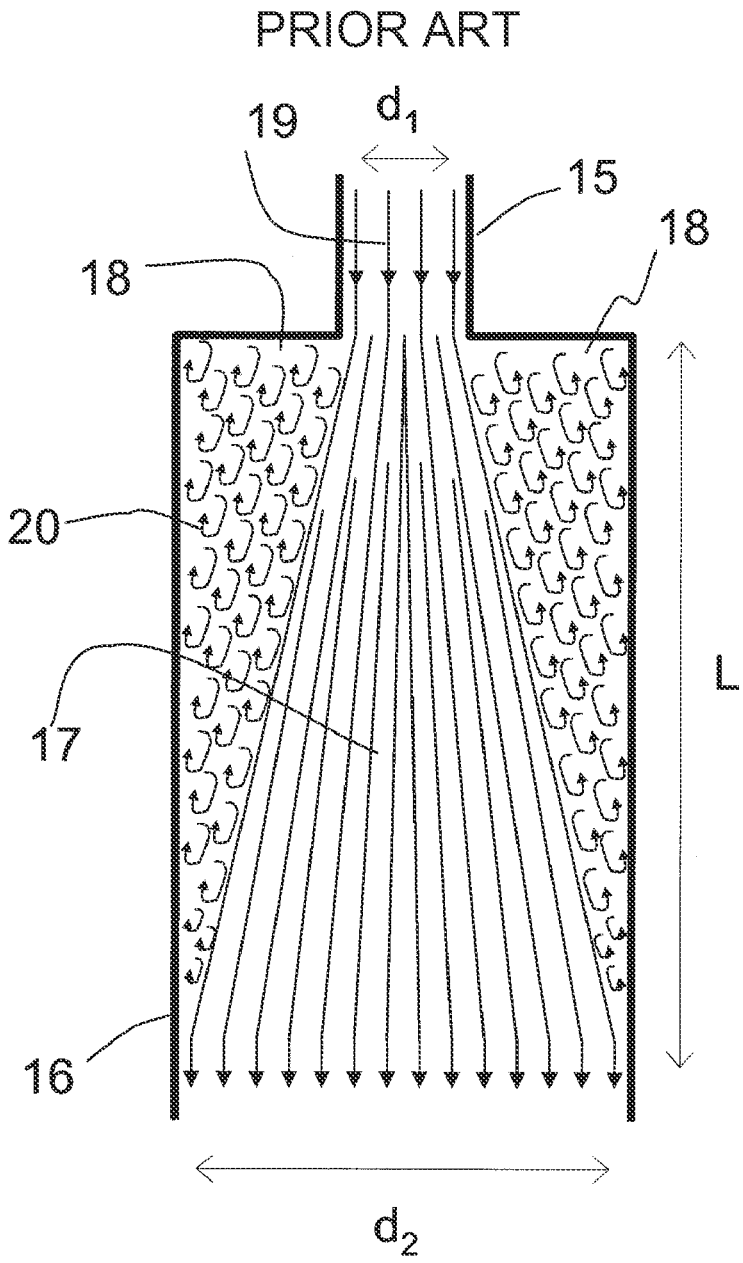
FIG. 3 is a general fluid streamline representation of a sudden expansion of a fluid flow.

The typical behavior of a fluid flow entering the inlet tank 6 of a heat exchanger 1 through an inlet connector 8 can best be described with reference to FIG. 3. As a fluid flow 19 traveling through a first flow passage 15 having a hydraulic diameter of $d_1$ abruptly expands into a second flow passage 16 having a hydraulic diameter $d_2$ substantially greater than $d_1$, a jet region 17 will develop with boundaries that extend from the circumference of the first flow passage to the circumference of the second flow passage a distance along the length L of the second flow passage. The jet region 17 is separated from the remaining medium 18 by a bounding surface that disintegrates into strong vortices 20. Beyond the distance, the jet 17 expands to the full cross-section of the passage 16, and the flow 19 continues through the flow passage 16 as an essentially uniform flow. The length of the jet 17 can typically be correlated to the hydraulic diameter of the second flow passage 16, and will often be approximately equal to some multiple of that hydraulic diameter. This type of behavior is well-known within the field of fluid dynamics and can be found described in fluid dynamics textbooks such as *Handbook of Hydraulic Resistance* (3rd edition) by I. E. Idelchik, published in English by CRC Press in 1994.

Figure 2:
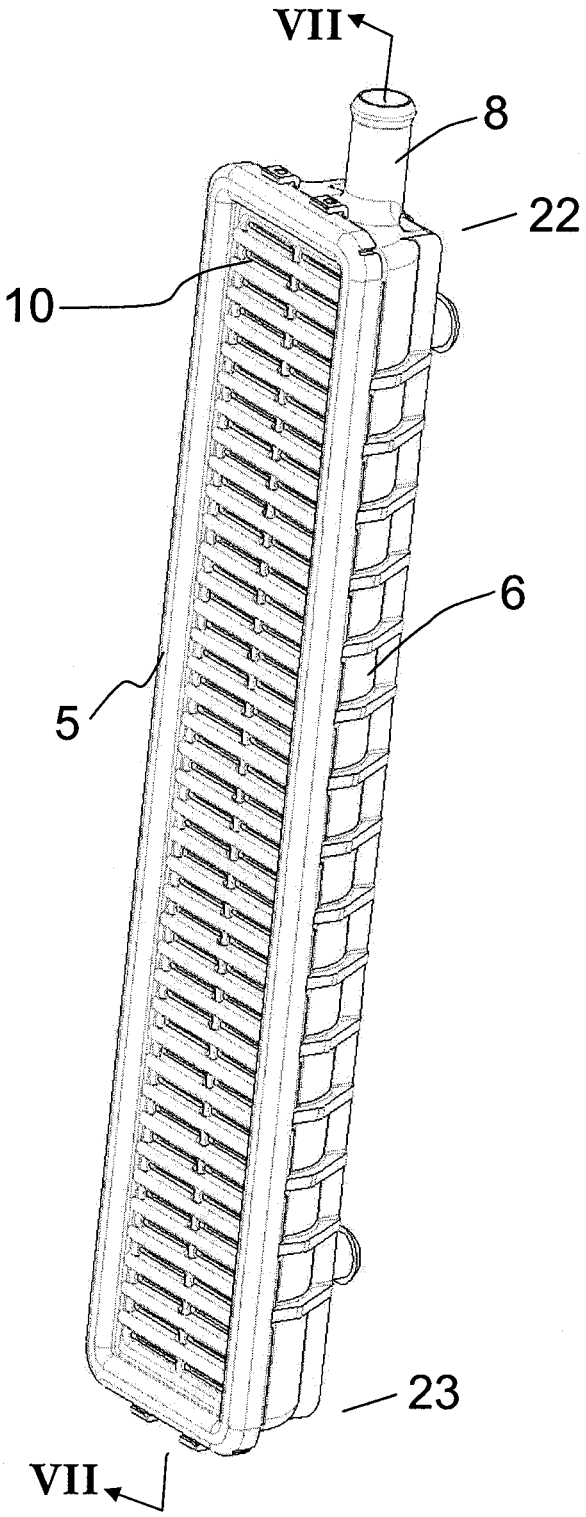
FIG. 2 is an isometric view of a portion of the heat exchanger of FIG. 1.
Figure 7:
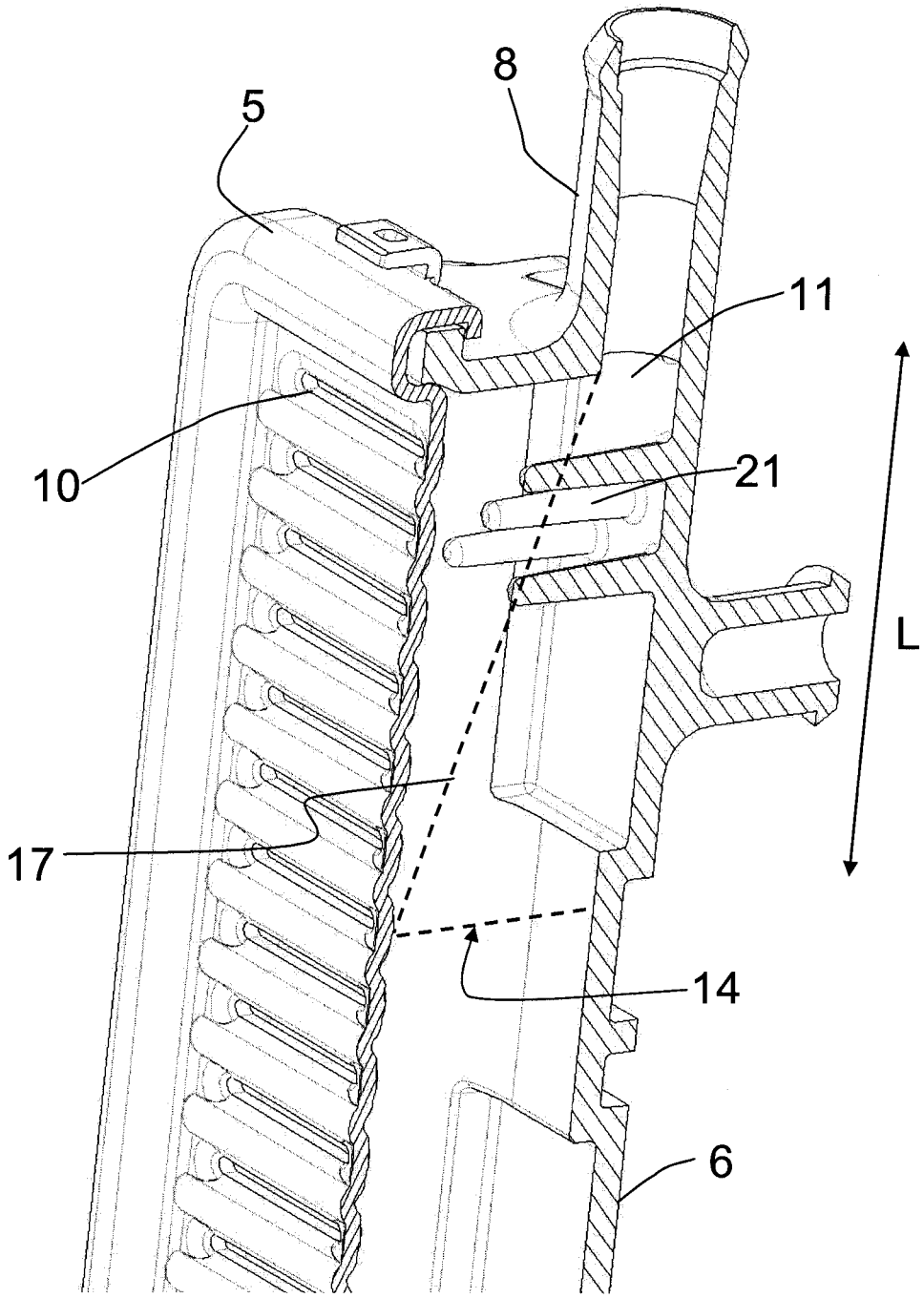
FIG. 7 is an isometric partial cross-sectional view along the lines VII-VII of FIG. 2.

In the case of the heat exchanger 1 of FIGS. 1 and 2, the formation of such a jet can have undesirable effects on the distribution of fluid flow between each of the tubes 3. When at least some of the tube slots 10 are located closer to the tank inlet port than the jet length L (as shown in FIG. 7), the inventors have found that the volume of fluid entering the tubes 3 corresponding to those tube slots 10 can be substantially less than the volume of fluid that would enter the tubes 3 if the flow was more uniformly distributed between all or substantially all of the tubes 3. Also, the volume of fluid entering the tubes 3 positioned at and beyond the jet length L is substantially more than these tubes would receive if the flow was more uniformly distributed between all or substantially all of the tubes 3. As a result, the volume of fluid in the inlet tank 6 is disproportionately distributed to the tubes 3 of the heat exchanger core 2, which decreases the operational efficiency and effectiveness of the heat exchanger 1.

Figure 4:
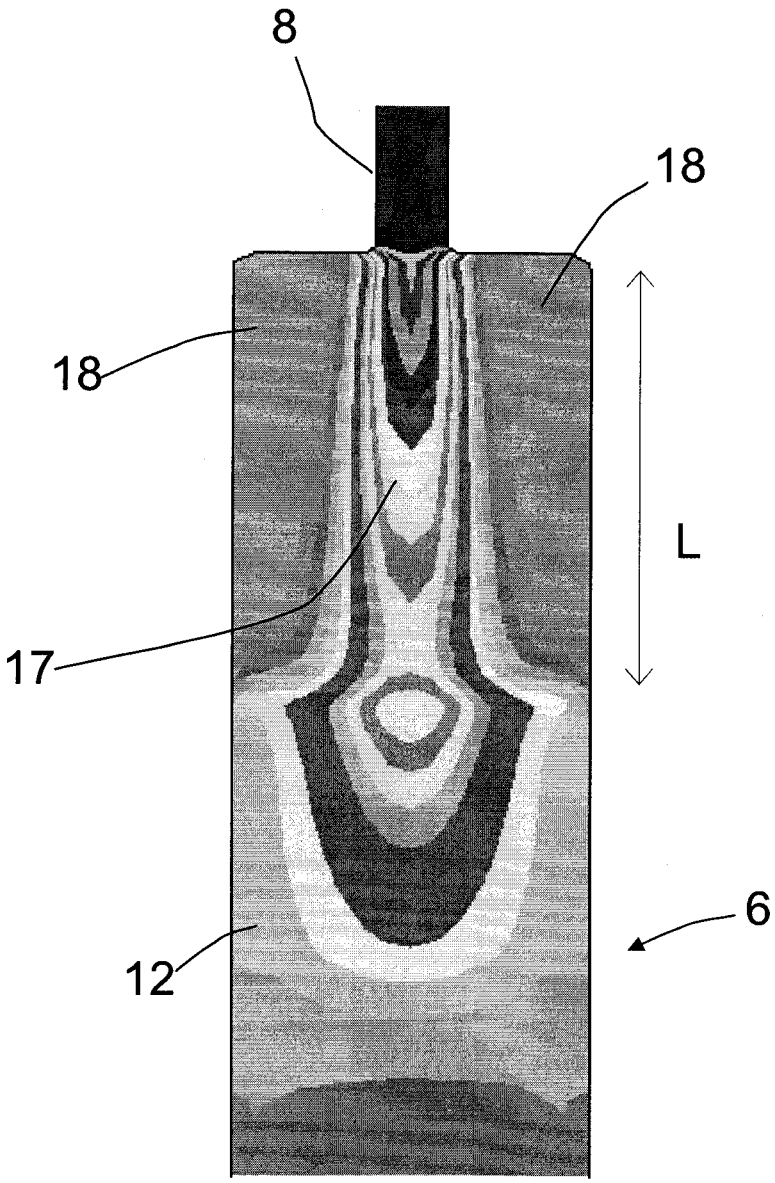
FIG. 4 is a shaded contour plot of a velocity profile within the heat exchanger of FIG. 1 without benefit of the invention.

By performing numerical simulations of fluid flow through a heat exchanger 1 lacking any internal flow distributing features at typical operating conditions of a vehicle radiator, the inventors found that a jet region would indeed develop in the inlet tank 6. FIG. 4 illustrates the velocity contours of a fluid flow expanding from the inlet connector 8 into the volume of the tank 6. In the contour plot of FIG. 4, each line defining a boundary between differing shades of grey indicates a line of constant fluid velocity magnitude. As can be seen in FIG. 4, the fluid expands into the inlet tank 6 as a high-velocity jet 17 separated from the remaining fluid medium 18, the jet expands for a length L until the fluid medium 18 fills substantially the entire cross-sectional area of the tank 6. In the region 12 of the tank 6 located downstream of the length L, the fluid quickly exhibits a more uniform flow velocity. For some typical operating conditions such as the one depicted by the contour plot of FIG. 4, the length L is equal to approximately two times the hydraulic diameter of the inlet tank 6. For other typical operating conditions, the ratio of the length L to the hydraulic diameter may be less than or greater than two, and in many cases may be between one and five.

Figure 5:
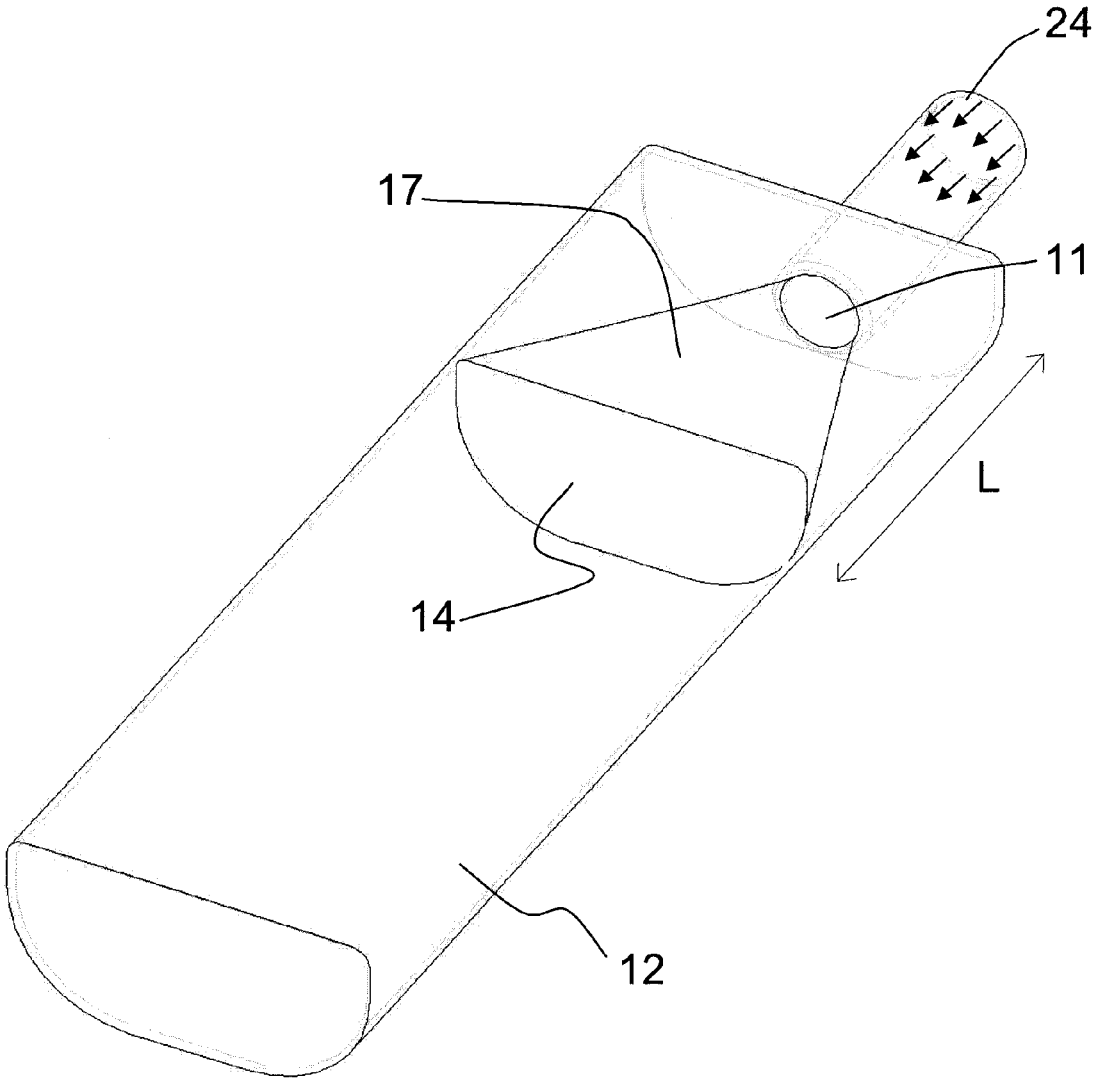
FIG. 5 is a partial isometric view of a portion of a fluid volume within a heat exchanger especially suited for deriving benefit from an embodiment of the present invention.

The inventors have found that by introducing a flow diverter within a jet region volume of the inlet tank of the heat exchanger 1, the flow distribution can be greatly improved between and along each of the heat transfer tubes 3. As best seen in FIG. 5, a jet region 17 can be defined within a fluid volume 12 occupying the internal volume of the inlet tank 6 of a heat exchanger 1, the fluid volume 12 receiving a fluid flow 24 through an inlet port 11, and the fluid flow 24 entering into the fluid volume 12 in a flow direction defined by the inlet port 11. The fluid flow 24 may be delivered to the inlet port 11 through, for example, an inlet connector 8 as shown in FIGS. 1 and 2.

As shown in FIG. 5, a generally frustoconical voluminous region 17 can be defined as being bounded by the inlet port 11, a cross-section 14 of the fluid volume 12 located in a plane substantially perpendicular to the flow direction defined by the inlet port 11 and spaced a distance L away from the inlet port 11, and a blended boundary extending generally linearly from the inlet port 11 to the interior of the tank wall at the intersection with the selected cross-section 14. While reference is made herein to a generally frustoconical voluminous region 17, in some embodiments, the region 17 can have other shapes and configurations (e.g., a truncated pyramid or a more irregular shape) because the shape and configuration of the region 17 can be defined, at least in part, by the size and shape of the inlet port 11, which can itself have any one of a number of different shapes (e.g., round, square, oval, and the like), and the cross-sectional size and shape of the tank at the location of the chosen cross-section 14.

Figure 6:
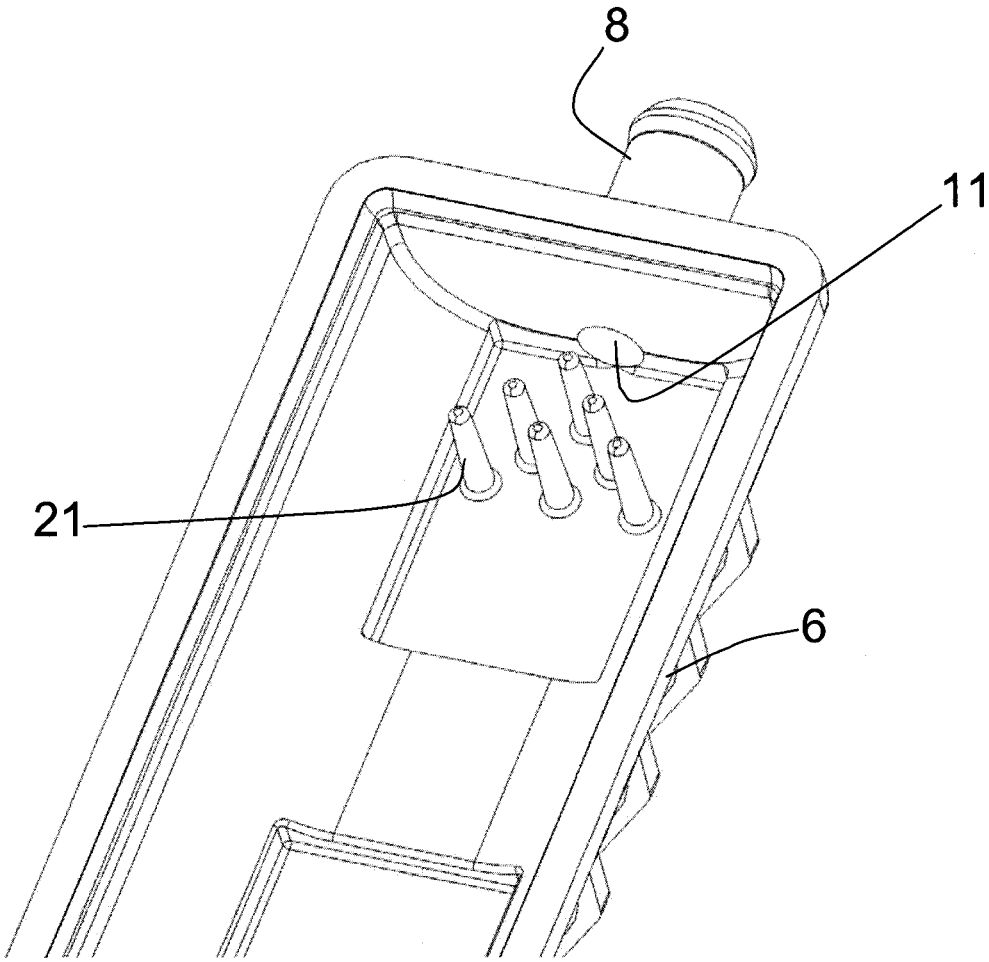
FIG. 6 is a partial isometric view of an inlet tank for use in an embodiment of the present invention.

In an embodiment of the invention illustrated by FIG. 6, a flow diverter including one or more elongated protrusions or projections 21 can be positioned within the voluminous region 17 (not explicitly shown in FIG. 6). These projections 21 can divert at least a portion of the fluid flow entering the tank 6 in a first flow direction to a different direction, thereby changing the velocity profile of the fluid flow in the tank. In some embodiments, the projections 21 can divert a portion of the fluid flowing inside the voluminous region 17 in generally straight-line fluid flow paths from the inlet port 11 out of the region 17. Further numerical simulation of flow through the heat exchanger 1 with such projections 21 present has shown that the distribution of the fluid flow through the heat exchanger core 2 can be greatly improved. In one embodiment, the projections 21 can be sized and positioned such that substantially no (or at least comparatively few) straight flow paths exist from the inlet port 11 to the cross-section 14 of the voluminous region 17. In other words, substantially all fluid flow paths extending linearly from the inlet port 11 to the cross-section 14 are diverted away from or around one or more of the projections 21.

In some embodiments, such as the one shown in FIG. 6, it may be desirable for the projections 21 to include a first group arranged in a row located a first distance away from the inlet port 11, and to further include a second group arranged in a row located a second, different distance away from the inlet port 11. It may be especially desirable to arrange the projections 21 in the first and second group such that a line connecting one of the projections 21 in the first group to one of the projections in the second group is substantially non-parallel to the direction of the flow entering through the inlet port 11. In some embodiments, the projections 21 can be arranged to form a wedge such that one projection is positioned closer to the inlet (or a distance along the length of the tank less) than at least two other projections 21. In some embodiments, a first line from any point within the cross-sectional area of the inlet port 11 and a first projection 21 is non-parallel to a second line from the same point to a second projection 21. In further embodiments, a third line from the same point to a third projection 21 is non-parallel to the first and second lines.

In some embodiments, such as the ones depicted, the projections 21 may be generally cylindrical. However, in other embodiments the projections 21 may be square, rectangular, triangular, octagonal, airfoil shaped, or other shapes. In some embodiments, one or more of the projections 21 can have a substantially constant cross-sectional shape extending between proximate and distal ends along a longitudinal axis or dimension, while in other embodiments, one or more of the projections 21 can be tapered, bent, and/or contoured so as to have non-constant cross-sectional shapes between proximate and distal ends. In the illustrated embodiments, the projections 21 do not extend completely across the interior of the tank between opposite walls of the tank, in some embodiments, one or more of the projections 21 may extend across the entire or substantially the entire width of the tank 6. In the illustrated embodiments, the longitudinal dimension of each of the projections 21 is parallel to the longitudinal dimension of the other projections 21, in some embodiments, the projections 21 can be positioned such that the longitudinal dimension of one is non-parallel to that of another.

In the illustrated embodiment of FIG. 6, the projections 21 extend inwardly generally perpendicularly from a single common wall of the tank 6 and transverse to the first flow direction. In other embodiments, projections 21 can extend inwardly from two or more different walls of the tank 6. Alternatively or in addition, one or more of the projections 21 can extend from the wall at an angle other than 90 degrees. In still other embodiments, the tank 6 can be substantially cylindrically shaped and the projections 21 can extend inwardly from the tank wall such that the projections 21 either converge toward a central longitudinal axis of the tank 6 or a substantially constant distance is maintained between adjacent projections 21 between proximate and distal ends of the adjacent projections 21.

In some embodiments of the invention, the flow diverter can take other forms such as one or more plates with holes defined therein or one or more screens positioned within the voluminous region 17 in a plane generally non-parallel to the first flow direction. Some embodiments can incorporate a number of the elements described herein and can vary in size, shape, and orientation. In some embodiments, the flow diverter can be integrally formed with a wall of the tank.

When one or more of the tube slots 10 in the header 5 are located closer to the inlet port 11 than the distance L, as is shown in the embodiment of FIG. 7, then the present invention can be especially beneficial in improving (i.e., equalizing) the flow distribution to the tubes 3 the heat exchanger core 2 (removed for clarity in FIG. 7). In such an embodiment, the projections 21 can direct a portion of the fluid flow entering through the inlet port 11 out of the jet region prior to reaching the distance L, thereby increasing the volume of fluid entering the tubes closest to the inlet 11. Another portion of the fluid flow will, in contrast, make its way around the projections 21 and will exit the jet region 17 through the cross-section face 14 so that the remainder of the tubes 3 can still be adequately supplied with fluid.

Figure 8:
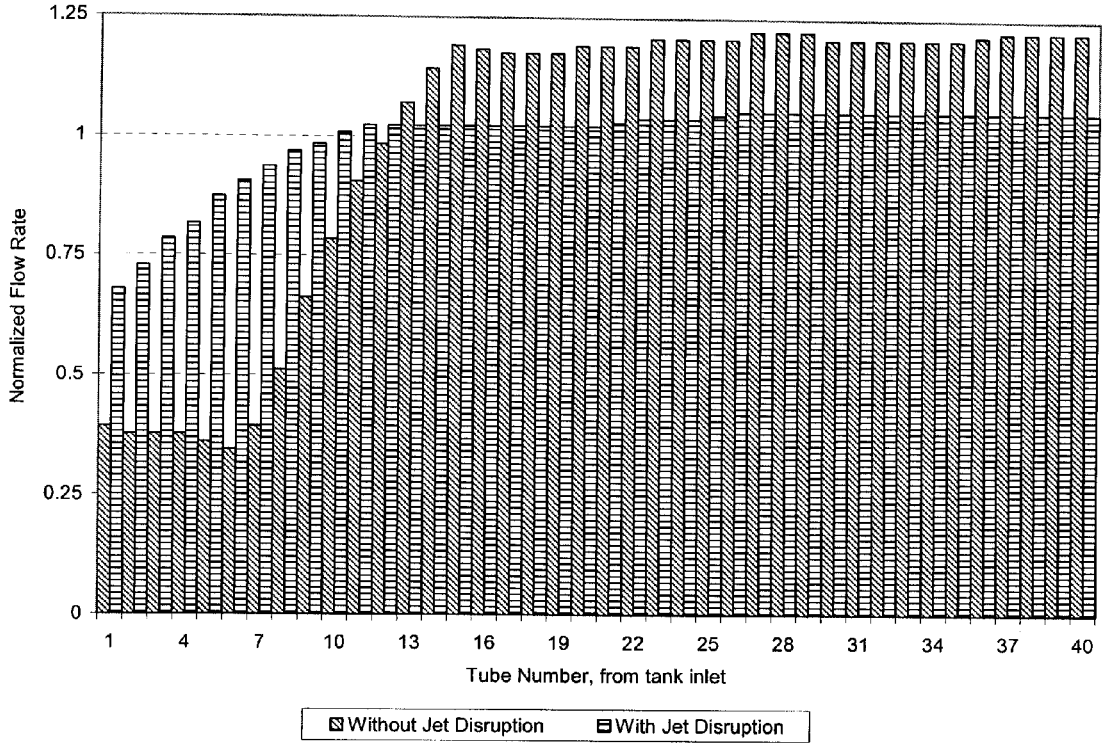
FIG. 8 is a graph comparing the fluid flow distribution in a heat exchanger with and without benefit of an embodiment of the present invention.

The graph of FIG. 8 compares the flow distribution between tubes, as predicted by numerical simulation, for the embodiments of the heat exchanger 1 with and without the flow diverter shown in FIGS. 6 and 7. The normalized flow rate is calculated as the ratio of the individual tube flow rate divided by the theoretical perfectly distributed flow rate, so that a perfectly distributing heat exchanger would exhibit all tubes having a unity normalized flow rate. As illustrated, the heat exchanger with the projections 21 allows for more fluid to be delivered to the tubes 3 closest to the inlet port 11, thus improving the normalized flow rate of those tubes 3 to a value that is closer to perfect distribution. In so doing, the problem of over-feeding the tubes 3 located further away from the inlet 11 is substantially improved as well. It should be recognized that the improved fluid distribution resulting from the addition of the flow diverter can result in a better performing heat exchanger.

Various alternatives to the certain features and elements of the present invention are described with reference to specific embodiments of the present invention. With the exception of features, elements, and manners of operation that are mutually exclusive of or are inconsistent with each embodiment described above, it should be noted that the alternative features, elements, and manners of operation described with reference to one particular embodiment are applicable to the other embodiments.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention.

What is claimed is:

1. A heat exchanger comprising:

a tank having a first end and a second end defining a tank length therebetween;

a connector positioned at the first end of the tank and providing an inlet for fluid flow into the tank in a first general flow direction;

a plurality of tube slots defined along the length of the tank between a first position adjacent the first end and a second position adjacent the second end, each tube slot receiving a tube, each tube providing an outlet for fluid flow from the tank in a second general flow direction, the second flow direction at a non-parallel angle with respect to the first general flow direction; and a flow diverter positioned in the tank at a third position between the first position and the second position to direct at least a portion of fluid flow away from the first general flow direction and thereby distribute the fluid flow from the inlet substantially evenly to each of the plurality of tubes, the flow diverter including at least one elongated projection oriented such that the elongated dimension is generally transverse to the first general flow direction, wherein the flow diverter defines a plurality of elongated projections, and wherein the plurality of elongated projections are arranged to form a wedge such that a first projection is positioned closer to the inlet than at least two other projections.

2. The heat exchanger of claim 1, wherein the flow diverter is positioned on a tank wall extending between the first and second ends.

3. The heat exchanger of claim 1, wherein the non-parallel angle between the first and second general flow directions is an angle between 45 and 135 degrees.

4. The heat exchanger of claim 1, wherein the non-parallel angle between the first and second general flow directions is an angle of approximately 90 degrees.

5. The heat exchanger of claim 1, wherein the flow diverter is arranged so as to preclude a majority of straight-line fluid flow paths from the connector to any one of the plurality of tube slots.

6. A heat exchanger comprising:

a tank having a first end and a second end defining a length therebetween and a cross-sectional area of the tank transverse to the length;

an inlet orifice defined at the first end of the tank through which fluid flows in a first direction into the tank, the inlet orifice having a cross-sectional area transverse to the first direction;

a voluminous region of the tank extending a distance from the first end and defined by boundaries which extend generally linearly from the circumference of the cross-sectional area of the inlet orifice to the circumference of the cross-sectional area of the tank at said distance;

a plurality of apertures arranged along the length of the tank, each aperture receiving one of a plurality of conduits, each conduit providing an outlet for fluid flow from the tank in a second direction, the second flow direction at a non-parallel angle with respect to the first flow direction; and a flow diverter positioned within the voluminous region of the tank to direct a portion of fluid flow out of the voluminous region and thereby distribute the total volume of fluid flow from the inlet substantially uniformly between the plurality of conduits, wherein the flow diverter is arranged so as to preclude a majority of straight-line fluid flow paths from the inlet orifice to the cross-sectional area of the tank at said distance, wherein the flow diverter includes a plurality of elongated projections, and wherein the elongated projections have a generally cylindrical shape.

7. The heat exchanger of claim 6, wherein said distance is between one and five times the hydraulic diameter of the tank, the hydraulic diameter of the tank being defined by the cross-sectional area thereof.

8. The heat exchanger of claim 6, wherein each of the plurality of elongated projections is positioned generally transversely with respect to the first direction.

9. The heat exchanger of claim 8, wherein the plurality of elongated projections are arranged to form a wedge such that a first projection is positioned closer to the inlet than at least two other projections.

10. The heat exchanger of claim 6, wherein the flow diverter is positioned on a wall of the tank.

11. The heat exchanger of claim 10, wherein the tank is formed of a plastic material and the flow diverter is integrally formed with the tank.

12. The heat exchanger of claim 6, wherein the non-parallel angle between the first and second directions is an angle between 45 and 135 degrees.

13. The heat exchanger of claim 6, wherein the non-parallel angle between the first and second directions is an angle of approximately 90 degrees.

14. The heat exchanger of claim 6, wherein the plurality of apertures are substantially aligned in a row along a wall of the tank from the first end to the second end.

15. The heat exchanger of claim 6, wherein the hydraulic diameter of the tank is greater than two times the hydraulic diameter of the inlet orifice, the hydraulic diameter of the tank and the inlet orifice being defined by the respective cross-sectional areas thereof.

16. A heat exchanger comprising:

a tank having a first end and a second end defining a length therebetween and a cross-sectional area of the tank transverse to the length;

an inlet orifice defined at the first end of the tank through which fluid flows in a first direction into the tank, the inlet orifice having a cross-sectional area transverse to the first direction;

a voluminous region of the tank extending a distance from the first end and defined by boundaries which extend generally linearly from the circumference of the cross-sectional area of the inlet orifice to the circumference of the cross-sectional area of the tank at said distance;

a plurality of apertures arranged along the length of the tank, each aperture receiving one of a plurality of conduits, each conduit providing an outlet for fluid flow from the tank in a second direction, the second flow direction at a non-parallel angle with respect to the first flow direction; and a flow diverter positioned within the voluminous region of the tank to direct a portion of fluid flow out of the voluminous region and thereby distribute the total volume of fluid flow from the inlet substantially uniformly between the plurality of conduits, wherein the flow diverter is arranged so as to preclude a majority of straight-line fluid flow paths from the inlet orifice to the cross-sectional area of the tank at said distance, wherein the flow diverter includes a plurality of elongated projections, wherein the plurality of elongated projections are arranged to form a wedge such that a first projection is positioned closer to the inlet than at least two other projections.

17. The heat exchanger of claim 16, wherein the elongated projections have a generally cylindrical shape.

18. The heat exchanger of claim 16, wherein said distance is between one and five times the hydraulic diameter of the tank, the hydraulic diameter of the tank being defined by the cross-sectional area thereof.

19. The heat exchanger of claim 16, wherein the flow diverter is positioned on a wall of the tank.

20. The heat exchanger of claim 19, wherein the tank is formed of a plastic material and the flow diverter is integrally formed with the tank.

21. The heat exchanger of claim 16, wherein the non-parallel angle between the first and second directions is an angle between 45 and 135 degrees.

22. The heat exchanger of claim 16, wherein the non-parallel angle between the first and second directions is an angle of approximately 90 degrees.

23. The heat exchanger of claim 16, wherein the plurality of apertures are substantially aligned in a row along a wall of the tank from the first end to the second end.

24. The heat exchanger of claim 16, wherein the hydraulic diameter of the tank is greater than two times the hydraulic diameter of the inlet orifice, the hydraulic diameter of the tank and the inlet orifice being defined by the respective cross-sectional areas thereof.

* * * * *